US010044119B2

(12) United States Patent
Janzen et al.

(10) Patent No.: US 10,044,119 B2
(45) Date of Patent: Aug. 7, 2018

(54) TERMINAL DEVICE HAVING A BUSBAR

(71) Applicant: Phoenix Contact GmbH & Co. KG, Blomberg (DE)

(72) Inventors: Wjatscheslaw Janzen, Detmold (DE); Holger Steinhage, Steinheim (DE); Andrea Goetze, Horn Bad Meinberg (DE); Oliver Pethig, Hespe (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/518,769

(22) PCT Filed: Oct. 7, 2015

(86) PCT No.: PCT/EP2015/073152

§ 371 (c)(1),
(2) Date: Apr. 13, 2017

(87) PCT Pub. No.: WO2016/058889

PCT Pub. Date: Apr. 21, 2016

(65) Prior Publication Data

US 2017/0244181 A1 Aug. 24, 2017

(30) Foreign Application Priority Data

Oct. 16, 2014 (DE) ..... 10 2014 115 048

(51) Int. Cl.
*H01R 9/22* (2006.01)
*H01R 9/26* (2006.01)
(Continued)

(52) U.S. Cl.
CPC ..... *H01R 9/2675* (2013.01); *H01R 4/242* (2013.01); *H01R 4/4818* (2013.01)

(58) Field of Classification Search
CPC ..... H01R 9/24; H01R 9/2675; H01R 9/26; H01R 31/02; H01R 43/24; H01R 4/363; H01R 4/4872
(Continued)

(56) References Cited

U.S. PATENT DOCUMENTS 4,940,431 A * 7/1990 Hennemann ..... H01R 9/26 439/715
5,022,873 A * 6/1991 Kollmann ..... H01R 9/2691 439/716
(Continued)

FOREIGN PATENT DOCUMENTS

DE 102007059640 A1 6/2009
DE 102011054425 A1 4/2013
(Continued)

*Primary Examiner* — Thanh Tam Le
(74) *Attorney, Agent, or Firm* — Leydig, Voit & Mayer, Ltd.

(57) ABSTRACT

A terminal device includes: a housing having at least one contact cavity; a contact part which is arranged in the at least one contact cavity and into which at least one electrical line can be plugged in order to make electrical contact with the contact part; and at least one busbar which is arranged on the housing, is electrically connected to the contact part, and a busbar portion of which extends along a height line. An end portion adjoins the busbar portion, which end portion extends in an oblique direction at an oblique angle to the height line and can be moved along the height line relative to the contact part.

11 Claims, 2 Drawing Sheets

(51) Int. Cl.
*H01R 4/242* (2018.01)
*H01R 4/48* (2006.01)

(58) Field of Classification Search
USPC ..... 439/709, 715, 716, 721, 722, 724, 811, 439/817
See application file for complete search history.

(56) References Cited

U.S. PATENT DOCUMENTS 5,334,054 A * 8/1994 Conrad ..... H01R 9/2608 439/716
5,816,843 A * 10/1998 Gerberding ..... H01R 4/2429 174/135
5,848,917 A * 12/1998 Bechaz ..... H01R 9/2675 439/716
5,853,304 A * 12/1998 Landreau ..... H01R 9/2675 439/716
6,146,213 A * 11/2000 Yoon ..... H01R 9/2616 439/532
6,655,982 B2 * 12/2003 Bolliger ..... H01R 4/2433 439/395
7,101,231 B2 * 9/2006 Prokup ..... H01R 4/4809 439/709
7,413,487 B1 * 8/2008 Chen ..... H01R 4/36 439/709
7,686,627 B2 * 3/2010 Wu ..... H01R 9/2691 439/95
7,690,952 B2 * 4/2010 Koellmann ..... H01R 9/2408 439/716
7,862,389 B2 * 1/2011 Pizzi ..... H01R 4/28 439/709
7,892,032 B2 * 2/2011 Pizzi ..... H01R 13/68 439/620.33
8,011,962 B2 * 9/2011 Pizzi ..... H01R 4/363 439/607.41
8,403,686 B2 * 3/2013 Pizzi ..... H01R 9/265 439/111
8,460,038 B2 * 6/2013 Eisert ..... H01R 9/2625 439/716
8,715,017 B1 * 5/2014 Barber ..... H01R 9/2408 439/716
2009/0111334 A1 4/2009 Diekmann
2009/0149074 A1 6/2009 Koellmann et al.
2014/0113502 A1 * 4/2014 Barber ..... H01R 4/4836 439/709

FOREIGN PATENT DOCUMENTS

EP 2393160 A1 12/2011
EP 2457289 A1 5/2012
WO WO 2009052949 A1 4/2009
WO WO 2010091984 A1 8/2010
WO WO 2011009837 A1 1/2011

* cited by examiner

TERMINAL DEVICE HAVING A BUSBAR

CROSS-REFERENCE TO PRIOR APPLICATIONS

This application is a U.S. National Phase application under 35 U.S.C. § 371 of International Application No. PCT/EP2015/073152, filed on Oct. 7, 2015, and claims benefit to German Patent Application No. DE 10 2014 115 048.1, filed on Oct. 16, 2014. The International Application was published in German on Apr. 21, 2016 as WO 2016/058889 A1 under PCT Article 21(2).

FIELD

The invention relates to a terminal device.

BACKGROUND

A terminal device of this type can in particular be in the form of a shunt terminal, which is used to wire equipment and to distribute one or more electric potentials. A plurality of electrical lines can usually be connected to one shunt terminal, different connections of the shunt terminal being at one or more potentials.

A terminal device of the type in the present case comprises a housing that forms at least one contact cavity. A contact part is arranged in the at least one contact cavity, into which contact part the at least one electrical line can be plugged in order to make electrical contact with the contact part. In addition, a busbar is arranged on the housing, which busbar is electrically connected to the contact part and a busbar portion of which extends along a height line.

Shunt terminals are known, for example, from EP 2 393 160 A1, DE 10 2007 059 640 A1, WO 2009/052949 A1 and WO 2010/091984 A1.

In a terminal device in the form of a shunt terminal known from EP 2 393 160 A1, a plurality of contact cavities are formed in each case on different housing sides of a housing, in which contact cavities one contact part is arranged in each case. In this case, the contact cavities on one of the housing sides are connected in pairs to the contact cavities on the other housing side via busbars, such that the paired contact cavities are at the same potential.

The fundamental problem in terminal devices of this type in the form of shunt terminals is that, during operation, the terminal devices are exposed to changing environmental conditions when used, for example, in an industrial plant. Changes in temperature can thus occur on a terminal device, which changes in temperature lead to a spatial expansion of the various components of the terminal device, which can then be problematic in particular if different components expand to different extents due to different thermal expansion coefficients, thus resulting in a spatial change in position of the components relative to one another.

Owing to its elongate extension, a busbar expands along a height line, usually preferably along the height line. If, for example, the housing on which the busbar is arranged expands, when heated, in a manner different from that of the busbar, because the thermal expansion coefficient of the housing, which is for example made of plastics material, is different from the thermal expansion coefficient of the material of the metal busbar, the position of the busbar relative to the contact parts to which the busbar is connected can change, which can have an adverse effect on the electrical transition between the busbar and the contact parts.

For this reason, in the terminal device from EP 2 393 160 A1 for example, a compensation region is provided approximately in the center of each busbar having portions of the busbar which extend at an angle to one another and which function as a compensation device for compensating relative changes in length.

In a terminal device known from DE 10 2007 059 640 A1, a busbar comprises end portions that perpendicularly adjoin a busbar portion and are rigidly connected to contact parts.

In a terminal device known from WO 2010/091 984 A1, obliquely extended end portions adjoin a central busbar portion and establish a rigid connection to the contact parts arranged on the end portions.

The problem addressed by the present invention is that of providing a terminal device which makes it possible to compensate for relative changes in position due to different thermal expansion coefficients of components of the terminal device in a simple, cost-effective and space-saving manner and which can ensure a secure, reliable electrical connection of a busbar to associated contact parts in contact cavities.

SUMMARY

In an embodiment, the present invention provides a terminal device, comprising: a housing having at least one contact cavity; a contact part which is arranged in the at least one contact cavity and into which at least one electrical line is configured to be plugged in order to make electrical contact with the contact part; and at least one busbar which is arranged on the housing, is electrically connected to the contact part, a busbar portion of which extends along a height line; and an end portion which adjoins the busbar portion, the end portion extending in an oblique direction at an oblique angle to the height line and being configured to be moved along the height line relative to the contact part.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
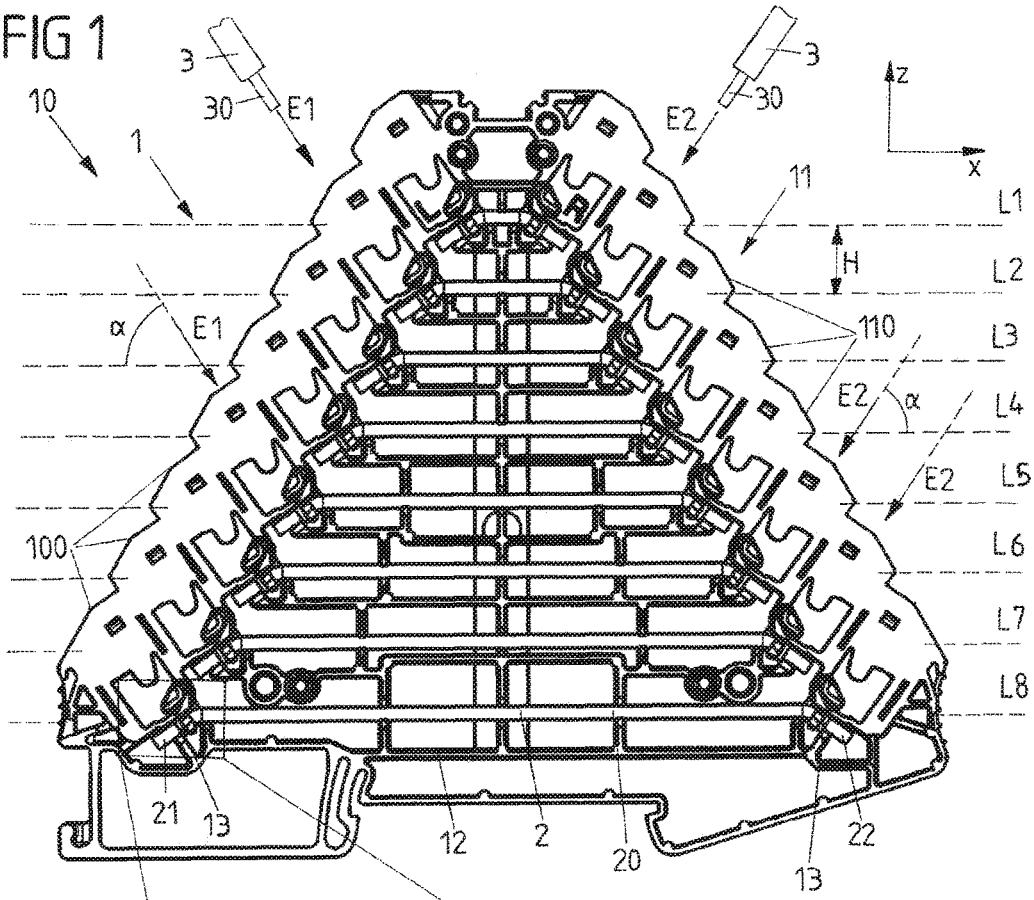
FIG. 1 is a side view of a terminal device in the form of a shunt terminal.

Accordingly, an end portion adjoins the busbar portion, which end portion extends in an oblique direction at an oblique angle to the height line and can be moved along the height line relative to the contact part.

This is based on the concept of providing compensation for changes in position resulting from an expansion of components of the terminal device having different thermal expansion coefficients in that the end portion of the busbar can be moved towards the contact part to which the busbar is electrically connected. The end portion extends in an oblique direction at an oblique angle to the height line, along which the (central) busbar portion of the busbar extends longitudinally. In this case, the busbar portion represents the line portion of the busbar, which extends for example between different contact cavities in the terminal device and thus provides a distribution of potential.

When the terminal device is heated, there is a change in length along the height line, in particular on the busbar portion extending along the associated height line, which causes the end portion adjoining the busbar portion to move relative to the contact part along the height line, which is easily possible owing to the movability of the end portion towards the contact part and in particular does not have an adverse effect on the electrical connection between the end portion and the contact part. Since the end portion extents obliquely to the height line, when the length of the busbar is changed due to an expansion along the height line when heated, the end portion is pushed instead towards the contact part without the electrical connection between the end portion and the contact part being lost.

The end portion extends in an oblique direction at an oblique angle to the height line and thus obliquely to the busbar portion. In this case, the oblique angle can have, for example, a value of between 20° and 70°, preferably between 30° and 45°, for example between 35° and 40°.

In this case, the oblique angle can be selected for example on the basis of a predetermined insertion direction in which a line can be inserted into a contact cavity in the housing. If a contact cavity is designed for example such that a line can be inserted into the contact cavity in an insertion direction that extends obliquely to the height line associated with the contact cavity, the end portion preferably extends towards the contact part associated with the contact cavity such that the oblique direction is perpendicular to the insertion direction. Both the insertion direction and the oblique direction thus describe an oblique angle to the height line and are arranged at right angles to one another.

In one embodiment, the contact part comprises two contact pins, between which the end portion of the busbar is arranged in an electrically contacting manner. The contact pins protrude for example in the insertion direction from a clip of the contact part and form between them an intermediate space in which the end portion is arranged. In this case, the end portion of the busbar can be moved along the height line in the intermediate space between the contact pins such that, when the length of the busbar expands relative to the housing, the end portion can be pushed into the intermediate space between the contact pins along the height line without the electrical contacting between the end portion and the contact pins being adversely affected thereby.

The busbar and the contact part, which distribute potential between the connected lines, are advantageously produced from an electrically conductive material, in particular a metal, for example copper. In contrast, the housing is advantageously produced from an electrically insulating material, for example plastics material.

In a specific embodiment, the busbar comprises two end portions which adjoin the busbar portion on different sides and are used for the electrical connection to two contact parts in two contact cavities. The busbar portion of the busbar extends along an associated height line and distributes potential between contact cavities arranged on either side of the busbar.

In the case of a terminal device in the form of a shunt terminal that is constructed in levels, a plurality of busbars is arranged at different heights in order to distribute potential between contact cavities that are located at different levels and are mutually offset in pairs. In this case, the busbar portion of each busbar extends along an associated height line, the busbars being mutually spaced perpendicularly to the height line in the vertical direction. In this case, the busbars can have different lengths along the associated height line thereof depending on the exact design of the terminal device.

The housing comprises, for example, at least one first contact cavity on a first housing side of the terminal device and at least one second contact cavity on another, second housing side of the terminal device. For example, a plurality of first contact cavities can be provided on the first housing side and a plurality of second contact cavities can be provided on the second housing side, a first contact cavity and a second contact cavity being associated with a height line in each case and being electrically interconnected via a busbar for the purpose of distributing potential.

A terminal device of this type in the form of a shunt terminal can be in the shape of a fir tree, for example, an upper busbar being shorter along the height line associated therewith than a lower busbar.

The busbar is secured to the housing, for example mechanically locked to the housing, which housing is produced for example from an electrically insulating material. The busbar can be formed by a round conductor, for example, which makes it possible to produce the busbar and the obliquely angled end portions thereof in a simple, cost-effective manner and makes it possible to mount the busbar on a housing in a simple manner.

FIG. 1 is a side view of a terminal device 1 in the form of a shunt terminal, in which a plurality of first contact cavities 100 is arranged on a first housing side 10 and a plurality of second contact cavities 110 is arranged on a second housing side 11. The terminal device 1 comprises a housing 12 made of an electrically insulating material, in particular plastics material, and can be plugged into a common mounting rail together with other terminal devices in the manner of a shunt terminal, in order to thus provide a terminal arrangement comprising a plurality of different terminals.

One or more electrical lines 3 can be plugged into the contact cavities 100, 110 in the terminal device 1 in each case. In this case, a line end 30 of a line 3 can be inserted into a contact cavity 100, 110 in an insertion direction E1, E2 and comes into electrical contact with a contact part 13 in the particular contact cavity 100, 110 when inserted into a contact cavity 100, 110.

In the terminal device 1 according to FIG. 1, the contact parts 13 of the contact cavities 100 on the first housing side 10 are connected in each case in pairs via busbars 2 to the contact parts 13 of the contact cavities 110 on the second housing side 11. The busbars 2 distribute potential between the contact cavities 100 on the first housing side 10 and the contact cavities 110 on the second housing side 11, extend along different height lines L1-L8 and are mutually spaced, in each case in pairs, by a distance H in the vertical direction Z perpendicularly to the height lines L1-L8.

In the embodiment shown, there are eight pairs of contact cavities 100, 110 which are at the same potential in each case owing to a busbar 2.

The line end 30 of a line 3 can be inserted into a contact cavity 100 on the first housing side 10 obliquely to the height lines L1-L8 in an insertion direction E1. The insertion of a line 3 into a contact cavity 110 on the second housing side 11 takes place, by contrast, in an insertion direction E2 which is also oriented obliquely to the height lines L1-L8, mirror-symmetrically to the vertical direction Z.

Both the insertion direction E1 for the first housing side 10 and the insertion direction E2 for the second housing side 11 describe an angle α to the height lines L1-L8.

A central busbar portion 20 of the busbars 2 extends along an associated height line L1-L8 in each case. End portions 21, 22, which establish an electrical connection to the contact parts 13 of the respectively associated contact cavities 100, 110, adjoin both sides of the central busbar portion 20, by means of which portion the busbar 2 is mechanically secured, for example mechanically locked, to the housing 12.

Figure 2:
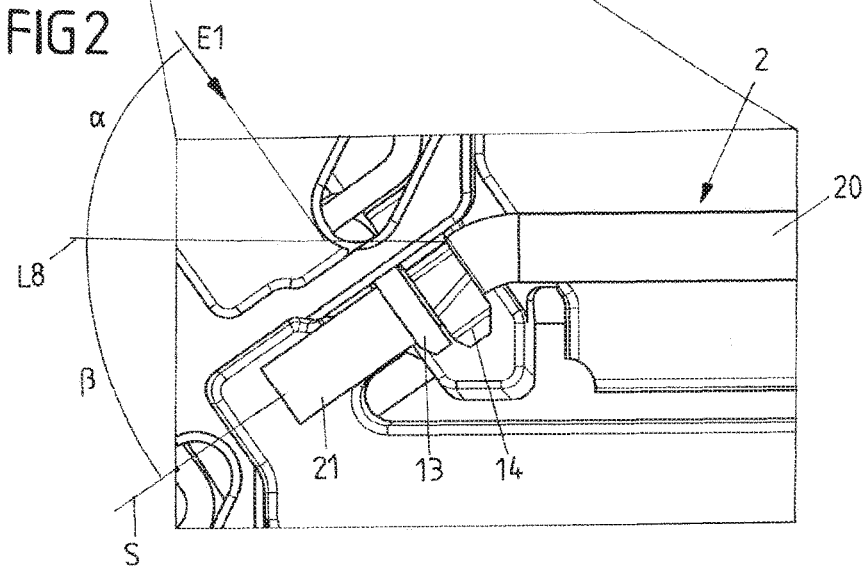
FIG. 2 is an enlarged view of a detail of the view according to FIG. 1.

As can be seen from FIG. 1 in conjunction with the enlarged view according to FIG. 2, each end portion 21, 22 extends obliquely to the height line L1-L8 associated with the busbar 2 in an associated oblique direction S at an angle ß. The angle ß can be for example between 20° and 70°, in particular between 30° and 45°. The angle ß, at which the oblique direction S of an associated end portion 21 extends relative to an associated height line L1-L8, and the angle α, at which the insertion direction E1, E2 for the particular contact cavity 100, 110 extends relative to the height line L1-L8, total 90°. The insertion direction E1, E2 for a contact cavity 100, 110 is thus oriented perpendicularly to the oblique direction S in which the end portion 21, 22 associated with the contact cavity 100, 110 extends.

Figure 3:
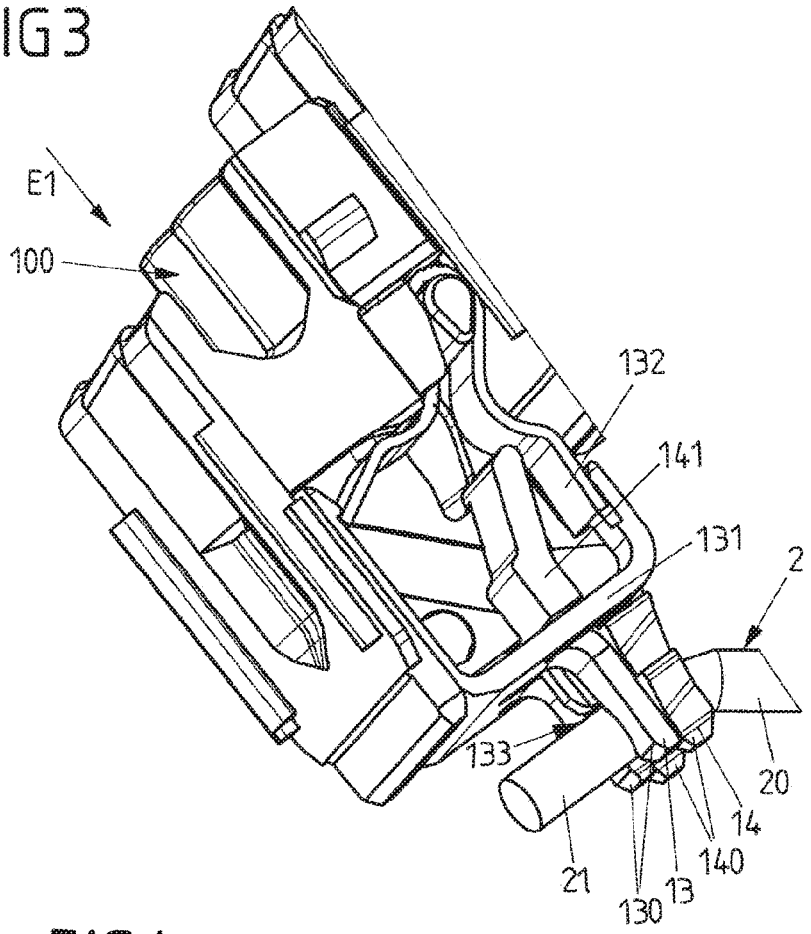
FIG. 3 is an enlarged perspective view of the terminal device in the region of a contact part in a contact cavity.
Figure 4:
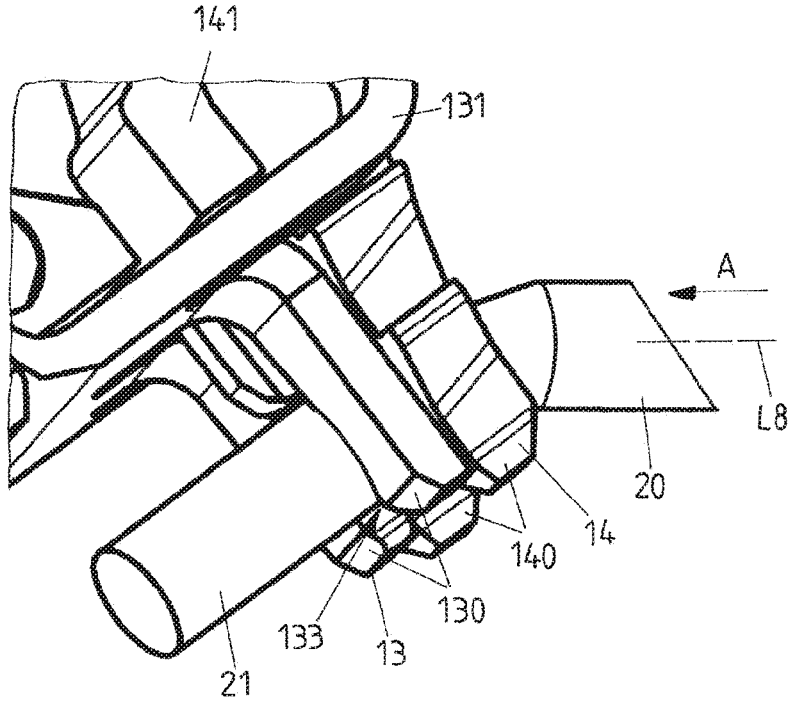
FIG. 4 is an enlarged view of a detail of the view according to FIG. 3.

As can be seen from FIG. 2 to FIG. 4, each end portion 21, 22 is located in an intermediate space 133 between contact pints 130 of the contact part 13. The contact pins 130 protrude from a clip 131 in the associated insertion direction E1, E2 and are electrically contacted with a contact spring 132 via the clip 131. When a line 3 is inserted in a contact cavity 100, 110, the line end 30 comes into electrical contact with the contact spring 132 and thus electrically contacts the contact part 13.

The contact part 13 is mechanically retained on a retaining part 14 which surrounds the associated end portion 21, 22 by means of pins 140 and mechanically secures the contact part 13 in the associated contact cavity 100, 110. A retaining leg 141 keeps the contact spring 132 in position.

Owing to the end portions 21, 22 extending on either side of the central busbar portion 20, in each case obliquely at an angle ß to the busbar portion 20, a reliable electrical connection between the busbar 2 and the respectively associated contact parts 13 is provided. In this case, the end portions 21, 22 are arranged in the intermediate space 133 between the pins 130 and the contact part 13 associated in each case such that each end portion 21, 22 can be moved at least to a certain extent in the intermediate space 133 along the height line L1-L8 along which the busbar portion 20 extends.

If, during operation of the terminal device 1, the various components of the terminal device 1 are heated, the different components may experience different changes in length owing to different thermal expansion coefficients. In this case, the elongate extension along the height lines L1-L8 preferably results in a change in length of the busbars 2 along the height lines L1-L8. However, a change in length of this type does not lead to the electrical connection of the busbars 2 to the associated contact parts 13 being adversely affected, because the end portions 21, 22 can move at least over a certain distance relative to the contact parts 13 and, when the busbars 2 are expanded, are pushed into the intermediate spaces 133 between the pins 130 and the respectively associated contact parts 13.

If an expansion A occurs longitudinally along the height line L1-L8 on a busbar 2 (see FIG. 4), the end portion 21, 22 moves at least slightly in the intermediate space 133 between the pins 130 of the associated contact part 13 and is pushed into the intermediate space 133 in the expansion direction A, meaning that the electrical connection between the end portion 21, 22 and the contact part 13 is strengthened and that in no case is the electrical transition between the contact part 13 and the busbar 2 adversely affected.

As can be seen in FIGS. 3 and 4, the different portions 20-22 of the busbar 2 are formed in one piece by a round conductor. Just like the associated contact parts 13, the busbar 2 is produced from a metal, highly electrically conductive material, for example copper.

The concept on which the invention is based is not restricted to the embodiments described above, but can in principle also be realized by entirely different kinds of embodiments. In particular, busbars of the type described here can also be used in other terminal devices as shunt terminals.

The design of a terminal device of this type is not necessarily mirror-symmetrical.

In addition, a plurality of busbars is not necessarily provided. A terminal device can In principle also use just one single busbar that has one or more end portions.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 shunt terminal
10, 11 housing side
100, 110 contact cavity
12 housing
13 contact part
130 pin
131 clip
132 contact spring
133 intermediate space
14 retaining part
140 pin
141 retaining leg
2 busbar

20 busbar portion
21, 22 end portion
3 line
30 line end
α, ß angle
A expansion direction
E1, E2 insertion direction
H distance
L1-L8 height line
S oblique direction
X horizontal direction
Z vertical direction

The invention claimed is:

1. A terminal device, comprising:

a housing having at least one contact cavity;

a contact part which is arranged in the at least one contact cavity and into which at least one electrical line is configured to be plugged in order to make electrical contact with the contact part;

at least one busbar which is arranged on the housing, is electrically connected to the contact part, and a busbar portion of which extends along a height line; and an end portion which adjoins the busbar portion, the end portion extending in an oblique direction at an oblique angle to the height line and being configured to be moved along the height line relative to the contact part, wherein the contact part comprises two contact pins, wherein the end portion of the at least one busbar is arranged between the two contact pins in an electrically contacting manner, wherein the end portion is configured to be moved between the two contact pins along the height line, wherein the two contact pins protrude from a clip of the contact part and extend perpendicularly to the oblique direction, and wherein an intermediate space in which the end portion is arranged is formed between the two contact pins.

2. The terminal device according to claim 1, wherein the oblique angle has a value of between 20° and 70°.

3. The terminal device according to claim 2, wherein the oblique angle has a value of between 30° and 45°.

4. The terminal device according to claim 3, wherein the oblique angle has a value of between 35° and 40°.

5. The terminal device according to claim 1, wherein the at least one electrical line is configured to be inserted into the at least one contact cavity in an insertion direction which is oriented obliquely to the height line associated with the at least one contact cavity.

6. The terminal device according to claim 5, wherein the oblique direction of the end portion extends perpendicularly to the insertion direction.

7. The terminal device according to claim 1, wherein the at least one busbar comprises two end portions which adjoin the busbar portion on different sides.

8. The terminal device according to claim 1, wherein the terminal device comprises a plurality of busbars which each comprise a busbar portion extending along a height line and are mutually spaced in the vertical direction perpendicularly to the height lines.

9. The terminal device according to claim 1, wherein the housing comprises at least one first contact cavity on a first housing side of the terminal device and at least one second contact cavity on another, second housing side of the terminal device.

10. The terminal device according to claim 9, wherein the housing comprises a plurality of first contact cavities on the first housing side and a plurality of second contact cavities on the second housing side, a first contact cavity and a second contact cavity being associated with a height line in each case and being electrically interconnected via a busbar.

11. The terminal device according to claim 1, wherein the at least one busbar comprises a round conductor.

* * * * *